US006311860B1

(12) United States Patent
Reidinger et al.

(10) Patent No.: US 6,311,860 B1
(45) **Date of Patent: *Nov. 6, 2001**

(54) CONTAINER CLOSURE CONTAINING GAME PIECE

(75) Inventors: Deborah Reidinger, Lake Forest; Tari Garza, Seal Beach; Donna Kahre, Seal Beach; Lauren Heller, Newport Beach, all of CA (US); David J. Marchi, Wilton; Cathy M. Bedini, Brookfield, both of CT (US)

(73) Assignee: Taco Bell Corp., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/400,158

(22) Filed: Sep. 21, 1999

Related U.S. Application Data

(63) Continuation of application No. 08/963,530, filed on Nov. 3, 1997, now Pat. No. 5,971,195.

(51) Int. Cl.[7] ..... B65D 1/36

(52) U.S. Cl. ..... 220/521; 215/228; 215/253; 220/212; 220/257; 220/271; 220/266; 220/713; 220/254; 220/359.2

(58) Field of Search ..... 220/254, 257, 220/521, 523, 711, 266, 268, 269, 270, 212, 256, 359.1, 359.2, 265, 709, 713; 215/232, 228, 227, 254, 253, 262, 305; 206/457, 217, 218; 40/310, 311

(56) References Cited

U.S. PATENT DOCUMENTS

| | | | | |
|---|---|---|---|---|
| D. 226,063 | * | 1/1973 | Warnberg . | |
| 844,114 | | 2/1907 | Foster . | |
| 1,545,028 | | 7/1925 | Armstrong . | |
| 1,885,757 | * | 11/1932 | Orlopp | 206/217 X |
| 2,120,403 | | 6/1938 | Godfrey . | |
| 2,276,678 | | 8/1942 | Wheeler . | |
| 2,766,796 | | 10/1956 | Tupper . | |
| 2,965,496 | | 12/1960 | Serdar . | |
| 3,048,317 | | 8/1962 | Cochrane et al. . | |
| 3,067,867 | | 12/1962 | Bonham et al. . | |
| 3,147,879 | | 9/1964 | Scholtz . | |
| 3,163,311 | | 12/1964 | Stolk . | |
| 3,179,275 | | 4/1965 | Roskam . | |
| 3,367,484 | | 2/1968 | Nelson . | |
| 3,391,847 | * | 7/1968 | Christine et al. | 220/359.2 X |
| 3,433,378 | * | 3/1969 | Ross . | |
| 3,459,324 | * | 8/1969 | Miller | 206/217 X |
| 3,485,353 | | 12/1969 | Reiter . | |
| 3,514,029 | * | 5/1970 | Powell | 206/217 X |
| 3,524,566 | * | 8/1970 | Parks | 220/713 X |
| 3,685,679 | | 8/1972 | Heffran . | |
| 3,734,276 | | 5/1973 | Bank . | |

(List continued on next page.)

FOREIGN PATENT DOCUMENTS

| | | | |
|---|---|---|---|
| 566898 | | 12/1958 | (CA) . |
| O 621 206 A1 | | 9/1989 | (EP) . |
| 449676 | * | 10/1991 | (FR) . |
| 2 190 893 A | | 12/1987 | (GB) . |
| WO 96/04181 | | 2/1996 | (WO) . |
| WO 97/11892 | | 4/1997 | (WO) . |

*Primary Examiner*—Allan N. Shoap
*Assistant Examiner*—Robin A. Hylton
(74) *Attorney, Agent, or Firm*—Knobbe, Martens, Olson & Bear LLP

(57) ABSTRACT

A closure provides a well in which a game piece is placed. The well has a side wall which supports a well floor. The well floor can contain an opening which can accommodate a drinking straw. A shield is located between the game piece and the well floor. The recessed well is covered by a sealing member which is adhered to an upper surface of the closure. The sealing member can have a pull tab and perforations which can be aligned with the edges of the pull tab. The perforations define a flap. The flap can be coupled to the closure through the use of a mounting flange.

9 Claims, 4 Drawing Sheets

U.S. PATENT DOCUMENTS

| | | | | |
|---|---|---|---|---|
| 3,779,372 | | 12/1973 | De Lloret . | |
| 3,822,030 | * | 7/1974 | Tanzer | 220/709 |
| 3,850,361 | | 11/1974 | Day et al. . | |
| 3,874,554 | * | 4/1975 | Chang | 206/217 X |
| 3,963,140 | | 6/1976 | Harding . | |
| 4,000,839 | | 1/1977 | Tecco et al. . | |
| 4,018,355 | * | 4/1977 | Ando | 220/366.1 X |
| 4,036,392 | * | 7/1977 | Martin | 220/521 |
| 4,074,827 | * | 2/1978 | Labe, III | 206/217 X |
| 4,079,857 | | 3/1978 | Crisci . | |
| 4,186,842 | | 2/1980 | Albert . | |
| 4,256,233 | | 3/1981 | Harding . | |
| 4,279,351 | | 7/1981 | Vertes . | |
| 4,340,138 | | 7/1982 | Bemhardt . | |
| 4,348,421 | * | 9/1982 | Sakakibara et al. | 206/217 X |
| 4,398,491 | | 8/1983 | Fridl et al. . | |
| 4,402,421 | * | 9/1983 | Reumer, Jr. . | |
| 4,432,153 | | 2/1984 | Bachman et al. . | |
| 4,438,865 | | 3/1984 | Scattaregi . | |
| 4,475,654 | | 10/1984 | Fruchter . | |
| 4,478,346 | * | 10/1984 | Spong | 220/521 X |
| 4,634,011 | | 1/1987 | Polyblank . | |
| 4,653,661 | * | 3/1987 | Buchner et al. | 220/369.1 X |
| 4,708,257 | | 11/1987 | Deline . | |
| 4,795,056 | | 1/1989 | Meyers . | |
| 4,911,320 | | 3/1990 | Howes . | |
| 4,927,048 | | 5/1990 | Howard . | |
| 5,056,659 | | 10/1991 | Howes et al. . | |
| 5,056,681 | | 10/1991 | Howes . | |
| 5,064,073 | | 11/1991 | Folland . | |
| 5,076,433 | | 12/1991 | Howes . | |
| 5,076,613 | | 12/1991 | Kovacs . | |
| 5,099,232 | | 3/1992 | Howes . | |
| 5,117,995 | | 6/1992 | Kau . | |
| 5,283,567 | | 2/1994 | Howes . | |
| 5,290,574 | * | 3/1994 | Jamieson et al. | 220/521 X |
| 5,375,828 | * | 12/1994 | Shikami . | |
| 5,397,023 | * | 3/1995 | Toczek et al. | 220/709 |
| 5,422,129 | * | 6/1995 | Draddy | 426/115 |
| 5,439,103 | | 8/1995 | Howes . | |
| 5,462,278 | | 10/1995 | Valyi . | |
| 5,482,158 | | 1/1996 | Plester . | |
| 5,524,788 | | 6/1996 | Plester . | |
| 5,529,179 | * | 6/1996 | Hanson | 206/217 X |
| 5,592,766 | | 1/1997 | Mygatt . | |
| 5,692,616 | * | 12/1997 | Baker | 220/713 X |
| 5,746,312 | * | 5/1998 | Johnson | 206/217 |
| 5,769,263 | | 6/1998 | Willingham et al. . | |
| 5,893,477 | * | 4/1999 | Kaneko et al. | 220/257 |
| 5,904,266 | * | 5/1999 | Tedeschi, Jr. | 220/521 |
| 5,971,195 | * | 10/1999 | Reidinger et al. | 215/227 X |
| 5,992,629 | * | 11/1999 | Gullord et al. | 206/459.1 |
| 6,056,144 | * | 5/2000 | Strange et al. | 220/709 X |
| 6,070,752 | * | 6/2000 | Nava et al. | 220/521 |

* cited by examiner

CONTAINER CLOSURE CONTAINING GAME PIECE

CROSS REFERENCE TO RELATED APPLICATION

This application is a continuation of U.S. Ser. No. 08/963,530 filed Nov. 3, 1997, which issued as U.S. Pat. No. 5,971,195, on Oct. 26, 1999.

BACKGROUND OF THE INVENTION

1. Field of the Invention

The present invention relates to a closure for a container. More specifically, the present invention relates to a closure for a beverage container which includes a removably-covered, recessed, well adapted to contain a game piece or prize.

2. Description of Related Art

Retailers often use promotional activities to increase the sales of their products. For instance, in the quick-service restaurant industry, restaurants often employ promotional games in which the customer can receive instant prizes and/or collect game pieces in an effort to earn prizes. Such games commonly use game pieces which consumers either immediately return or collect and return for prizes (e.g, free beverages or food).

Quick-service restaurants have previously delivered such game pieces to their customers in one of two ways. In connection with some prior promotions, restaurants have handed the games pieces to the patron upon completing the sale. Food and beverage containers have also been used to convey game pieces.

In one existing form, a game piece consists of a flexible paper tab which is adhered to the side of a container (e.g., a cup). The game piece thus readily conforms to and smoothly lies over either a planar or non-planar surface of the container. The game pieces are designed to be peeled off the surface to reveal the prize won by the patron or to convey other information to the patron.

Inflexible game pieces and prizes do not conform to the surfaces of food and beverage containers. Restaurants thus have previously distributed such game pieces apart from the containers. Quick-service restaurants, however, generally disfavor separate distribution because they cannot ensure that every customer receives a game piece with his or her purchase. Decoupling the game piece from the container also presents the risk that game pieces will be distributed without a product purchase.

SUMMARY OF THE INVENTION

A need therefore exists for a way to couple a rigid, noncomformable game piece with a product container in order to deliver together the game piece and the purchased product to a consumer.

The present invention involves the recognition that, in the context of at least the quick-service restaurant industry, placement of the game piece on the bottom side of the container increases the risk of spilling the food or beverage within the container. Some customers cannot wait until the container is empty, and may accidently tip the container when removing the game piece from the container's bottom side. In addition, the possibility exists that the consumer will not recognize the presence of the game piece on the underside of the container, and will unintentionally discard the game piece with the spent container. The game piece therefore is desirably integrated into the product packaging in a manner that allows removal of the game piece without increasing the risk of spillage, and in a manner that heightens the consumer's awareness of the game piece.

One aspect of the present invention thus involves a closure (e.g., lid) for a container. The closure comprises a hidden game piece, an upper surface and a side skirt that depends downward from the upper surface. The side skirt has at least one engaging member which cooperates with corresponding structure on the container to releasably secure the closure over an opening in the container. A recessed well is formed in the upper surface and has at least one side wall. The recessed well's side wall supports a bottom surface of the well below the upper surface. The game piece is located within the well and is covered by a sealing member. The sealing member is positioned on the upper surface with an outer perimeter of the sealing member being located between the side skirt and the side wall of the recessed well.

Another aspect of the present invention involves a closure for a container. The closure comprises an upper surface and a recessed well formed in the upper surface. The recessed well has at least one side wall. The recessed well's side wall supports a floor of the well below the upper surface. A game piece is located within the well and is covered by a sealing member. The sealing member is positioned to contact and lie atop of the upper surface such that a game piece is removably enclosed within the well.

A further aspect of the present invention involves a closure for a container which includes a hidden game piece. The closure generally comprises an upper surface having a recessed well. The well has a floor and contains a game piece. A shield is located between the game piece and the well floor. The well is covered with a sealing member which is affixed to the closure.

BRIEF DESCRIPTION OF THE DRAWINGS

These and other features, aspects and advantages of the invention will now be described with reference to the drawings of a preferred embodiment, which is intended to illustrate and not to limit the invention, and in which.

DETAILED DESCRIPTION OF THE PREFERRED EMBODIMENT

The present invention relates to a closure for a container which is capable of carrying a game piece or other type of prize. The closure has particular utility for use with a beverage container, and thus, the following describes the closure in the context of a lid for a beverage container. This environment of use, however, is merely exemplary. The present closure can be readily adapted by those skilled in the art with other types of closures, such as, for example, but without limitation, twist-tops, corks, stoppers, caps and the like.

Figure 1:
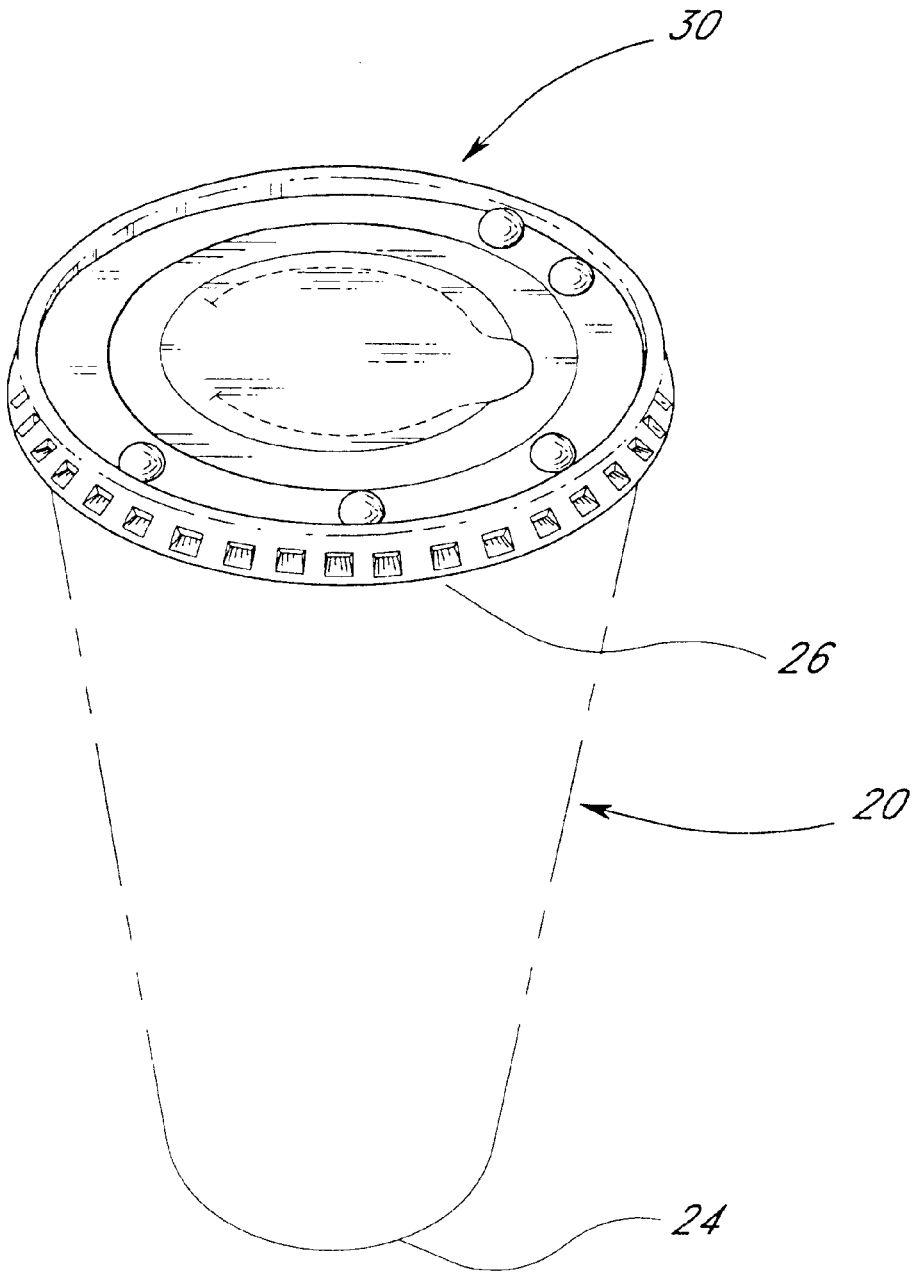
FIG. 1 is a perspective view of a closure configured in accordance with a preferred embodiment of the present invention, and illustrates the closure on a conventional beverage container.

Before describing the closure 30, an exemplary container will first be described in order to better understand the closure's design. In the illustrated embodiment shown in FIG. 1, the beverage container 20 has a substantially cylindrical sidewall having two ends: a bottom end 24 and a top end 26. The bottom end 24 is glued or otherwise connected to a container bottom (not shown) as is known in the art. The top end 26 is provided with an outwardly rolled lip (not shown), such that the rolled lip provides a thicker portion to the top end 26 of the container sidewall. The rolled lip cooperates with the closure 30 to secure the closure 30 onto the container 20, as described below.

With reference now to FIGS. 2–6, the lid 30 includes an upper surface 32 with a side skirt 36 and a recessed well 44 depending downward from the upper surface 32. A game piece 54 and a shield 56 are placed within the recessed well 44. The recessed well 44 is covered by a sealing member 60 which is adhered, or otherwise affixed, to the upper surface 32. These individual components will now be described in detail.

Figure 3:
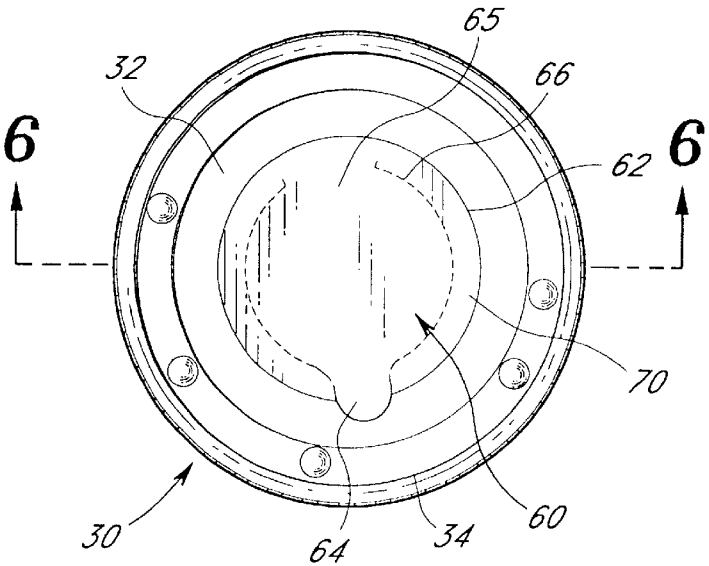
FIG. 3 is a top plan view of the closure of FIG. 2.

As shown in FIG. 3, the upper surface 32 has a perimeter 34 which defines the outer shape of the upper surface 32. Those skilled in the art will appreciate that many shapes may be used for the perimeter 34 of the upper surface 32. The perimeter 34 preferably corresponds to the external shape of the container to which the closure is attached. More preferably, the upper surface 32 is at least coextensive with the container opening at the top end 26. In the embodiment illustrated, the lid 30 has a circular-shaped perimeter 34 as shown in FIGS. 2–3.

Figure 4:
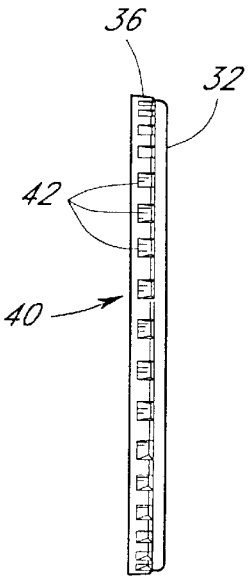
FIG. 4 is a side elevational view of the closure of FIG. 2.

The side skirt 36 depends from the upper surface 32, as best seen in FIG. 4. As such, the side skirt 36 has a shape which conforms to the shape defined by the perimeter 34 of the upper surface 32. In the illustrated embodiment, the side skirt 36 is substantially cylindrical in shape. The side skirt 36 is preferably sized to fit over the top end 26 of the container 20. One skilled in the art will also recognize that the present closure may also be utilized without a side skirt.

The side skirt 36 further includes at least one engaging member 40. The engaging member 40 can be a single crimp which extends at least partially around the circumference of the side skirt 36. The engaging member 40 can also be one or more threads designed to engage with a corresponding surface on the container. As will be appreciated by one skilled in the art, any of a variety of types of engagement can also be used.

Figure 2:
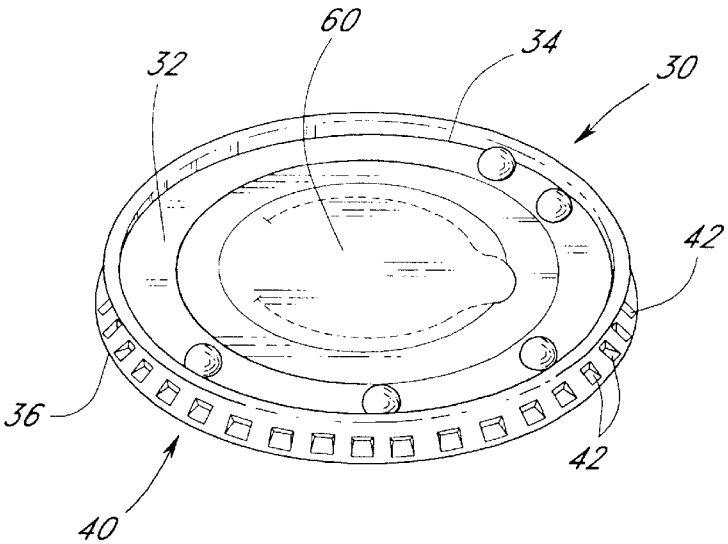
FIG. 2 is a perspective view of the closure of FIG. 1.

Alternatively, as shown in the illustrated embodiment of FIGS. 2–4, the engaging member 40 can be comprised of a series of inwardly extending depressions 42 from the side skirt 36. The depressions 42 cause the side skirt 36 to deflect slightly outward as the lid 30 is forced over the rolled lip of the container 20 such that an inward compressive force is created by the side skirt 36 on the rolled lip of the container 20. The lid 30 latches onto the rolled edge and is held in place by the combination of the engaging member 40 and the compressive forces. Thus, the engaging member 40 is provided in the present lid such that the lid 30 may be removably secured to the container 20.

Figure 5:
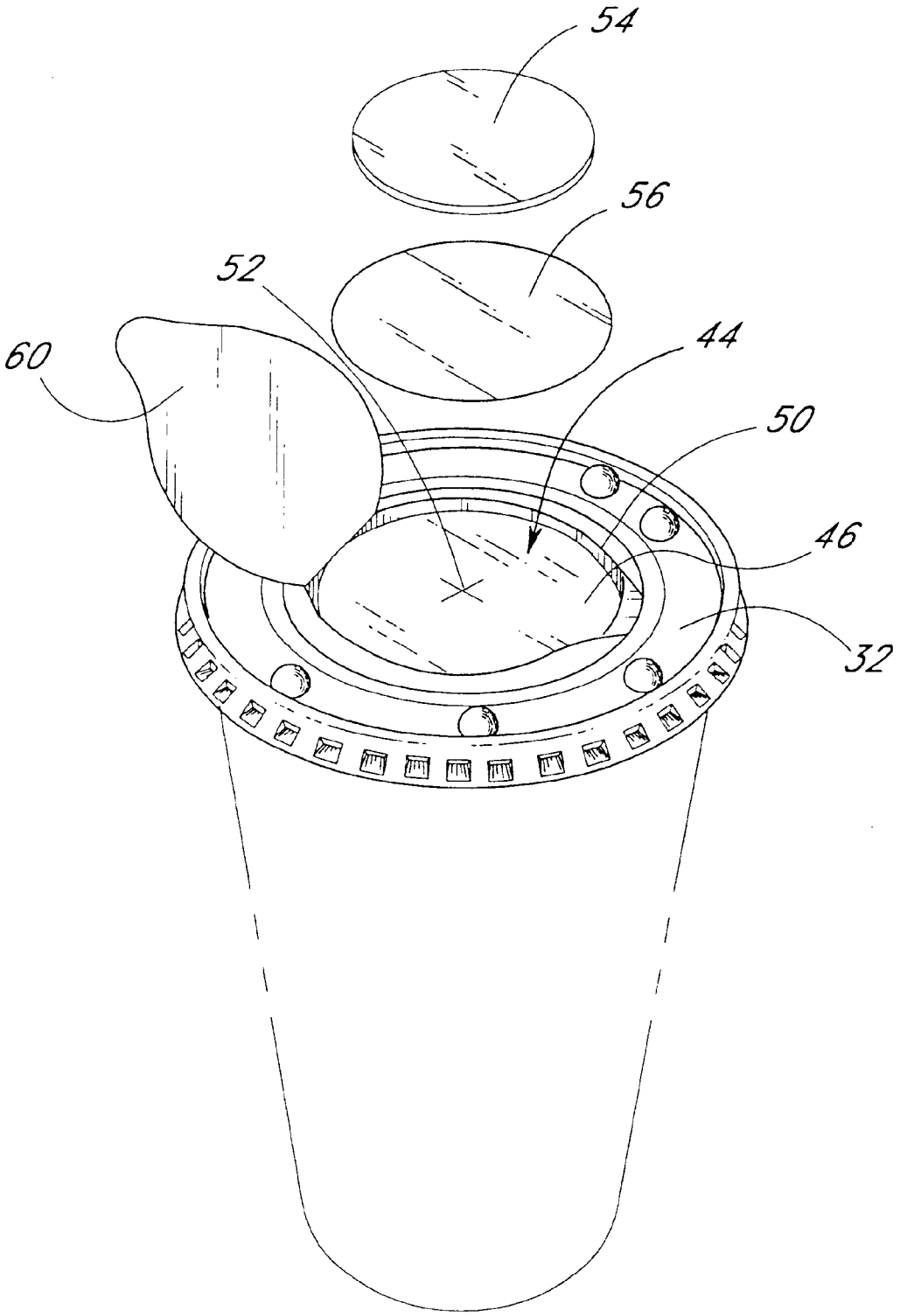
FIG. 5 is an exploded perspective view of the closure of FIG. 2.

As shown in FIG. 5, the closure 30 additionally has a recessed well 44 which depends downward from the upper surface 32. The recessed well 44 can be located anywhere on the upper surface 32. Preferably, the recessed well 44 is centrally located within the perimeter of the upper surface 32. The recessed well 44 includes a floor 46 and at least one side wall 50. The side wall 50 depends downwardly from the upper surface 32 of the lid 30. The side wall 50 is preferably substantially cylindrical; however, as those skilled in the art will recognize, the side wall 50 can alternatively be formed in any of a variety of other shapes. More preferably, the substantially cylindrical side wall 50 is concentric to the perimeter 34 of the upper surface 32.

As best seen in FIG. 5, the floor 46 of the well 44 is suspended by the side wall 50. The floor 46 may have various shapes. The floor 46 desirably matches the shape and size defined within the side wall 50. Thus, in the illustrated embodiment shown in FIG. 5, the floor 46 has a substantially circular shape. More preferably, the perimeter of the floor 46 is substantially concentric with the perimeter 34 of the upper surface 32 of the lid 30.

In the embodiment illustrated in FIG. 5, the floor 46 also contains an opening 52. The opening 52 desirably is adapted to receive a straw through which the beverage contained in the container 20 can be consumed. As recognized by those skilled in the art, the opening 52 can be of various formations including, but not limited to, a perforated circle, a perforated X-shape, or a hole.

The present closure is preferably manufactured in an inexpensive fashion in order to create a disposable product. The present closure is manufactured from a thermoplastic pliable material such as high density polyethylene; it will be recognized by one skilled in the art, however, that the closure can alternatively be manufactured from a variety of materials, including, but not limited to, metals, metal alloys, polystyrene, various impact grades of polystyrene and/or copolymers of styrene, various polyolefins such as polyethylene, polypropylene, or various polyacrylates or vinyl polymers and vinyl copolymers used in food package applications or blends of the above. The present closure is formed in a manner known to those skilled in the art such as, for example, but not limited to, injection molding, vacuum forming or other methods of thermoforming conventionally used to form closures and lids. The present closure differs from those of known in the art in that a recessed well of increased depth is created through use or tooling specially designed to create the recessed well. Advantageously, a pigment or dye is added to the present closure to create a substantially opaque closure. The opaque nature helps to protect the identity of a prize or game piece contained in the present closure.

The recessed well 44 is configured to receive a game piece 54. In the illustrated embodiment, as seen in FIG. 5, the game piece 54 has a coin-like shape. Those skilled in the art will appreciate that the game piece 54 can alternatively take many other shapes, forms, sizes and thicknesses. Preferably, as shown in FIG. 6, the game piece 54 is configured such that it lies flat within the recessed well 44.

The game piece 54 may be manufactured from many materials well known to those skilled in the art. The present game piece 54 is preferably cardboard with a glossy paper coating. Alternatively, the game piece may be manufactured from any of a variety of metal alloys, paper products, plastics, or other materials well known to those skilled in the art.

The present game piece 54 is preferably colored and marked with indicia related to the game being played. In particular, at least any point values which are associated with the game piece are indicated numerically on one side of the game piece 54. The name of the promotional game and other promotional material are preferably included on the opposite side of the game piece 54. Alternatively, the game piece may contain various indicia relating to the game for which it is designed. As will be appreciated by one skilled in the art, the game piece may also contain a layer of opaque coating which may be easily removed to reveal the markings and indicia of the game piece.

Figure 6:
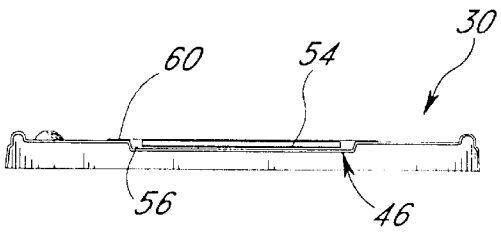
FIG. 6 is a cross-sectional view of the closure of FIG. 3 taken along line 6—6.

As seen in FIGS. 5 and 6, a shield 56 desirably lies between the game piece 54 and the well floor 46. The shield 56 is preferably made of a liquid-resistant material to protect the game piece 54 from exposure to any beverage which may enter the well 44 through the opening 52 in the well floor 46. Additionally, the shield 56 may be designed to be substantially opaque such that the game piece 54 may not be viewed through the well floor 46 of the lid 30. As shown in FIG. 5., the shield 56 is preferably a disc shape. Those skilled in the art will appreciate that the shield 56 can also be configured to correspond to the shape of any game piece 54 used within the lid 30, or alternatively, to correspond to the shape of the well floor 46.

The lid 30 also includes a sealing member 60 which is used both to provide a tamper-proof cover to the recessed well 44 and to ascertain the integrity of the game being played. As seen in FIG. 3, the sealing member 60 has an outer perimeter 62. When the sealing member 60 is placed upon the lid 30, the outer perimeter 62 of the sealing member 60 is preferably located between the top edge of the well sidewall 50 and the perimeter 34 of the upper surface 32.

The sealing member 60 preferably includes a pull tab 64. The pull tab 64, as seen in FIG. 3, extends slightly outward from the outer perimeter 62 of the sealing member 60. The pull tab is connected to a flap 65. The flap 65 is defined by perforations 66. As seen in FIG. 3, the perforations 66 form an open circle with the edges of the pull tab 64 aligned with the perforations 66. The pull tab 65 is located opposite the open, non-perforated portion of the open circle. One skilled in the art will readily recognize that the perforations and pull tab may also be configured in any number of combinations, shapes and sizes.

The perforations 66 desirably aid the patron in opening the sealing member 60 to reveal the game piece 54 located within the recessed well 44 beneath the sealing member 60. One skilled in the art will, however, also recognize that neither the pull tab 64 nor the perforations 66 are necessary in order to utilize the present invention. For example, a sealing member may be releasably secured to the upper surface of the lid such that the recess well is accessible without tearing the sealing member.

The portion of the sealing member 60 located between the outer perimeter 62 and the perforations 66 forms a mounting flange 70. An adhesive can non-removably couple the mounting flange 70 to the upper surface 32 of the lid 30. As such, the adhesive is located between the mounting flange 70 and the upper surface 32. The adhesive continues substantially around the entire circumference of the sealing member 60. However, the adhesive does not continue through the pull tab 64. Thus, the mounting flange 70 of the sealing member 60 may be retained on the lid 30 after opening. The flap 65 is connected to the mounting flange 70 at the area without perforations 66 which was discussed above.

The sealing member 60 can be manufactured from a standard label. The standard label generally includes a top substrate layer, an intermediate adhesive layer, and a bottom liner layer. The top substrate layer can be any of a variety of paper materials or other materials known to those skilled in the art. The outer perimeter 62 and the pull tab 64 are cut to create the shape of the sealing member 60. The perforations 66 are also cut in the present sealing member 60. Because of the perforations 66, the bottom liner layer may be removed from the mounting flange 70. Thus, the adhesive layer is exposed on only the mounting flange 70. The sealing member 60 can then be applied to the upper surface 32 of the lid 30.

Advantageously, the sealing member 60 is provided with a top and bottom surface capable of receiving print. Indicia of any promotional game utilizing the present lid can be applied to one surface of the sealing member 60. In addition, any rules, regulations or other information can be conveyed on the other surface of the sealing member 60.

When assembling the closure of the present invention, the lid is formed with the recessed well 44. The game piece 54 and shield 56 are formed. The game piece 54 and the shield 56 are then placed within the recessed well 44 of the lid 30. The recessed well 44, game piece 54, and shield 56 are then covered by the sealing member 60. The sealing member 60 is preferably affixed to the lid 30 using adhesive located on the mounting flange 70.

Figure 7:
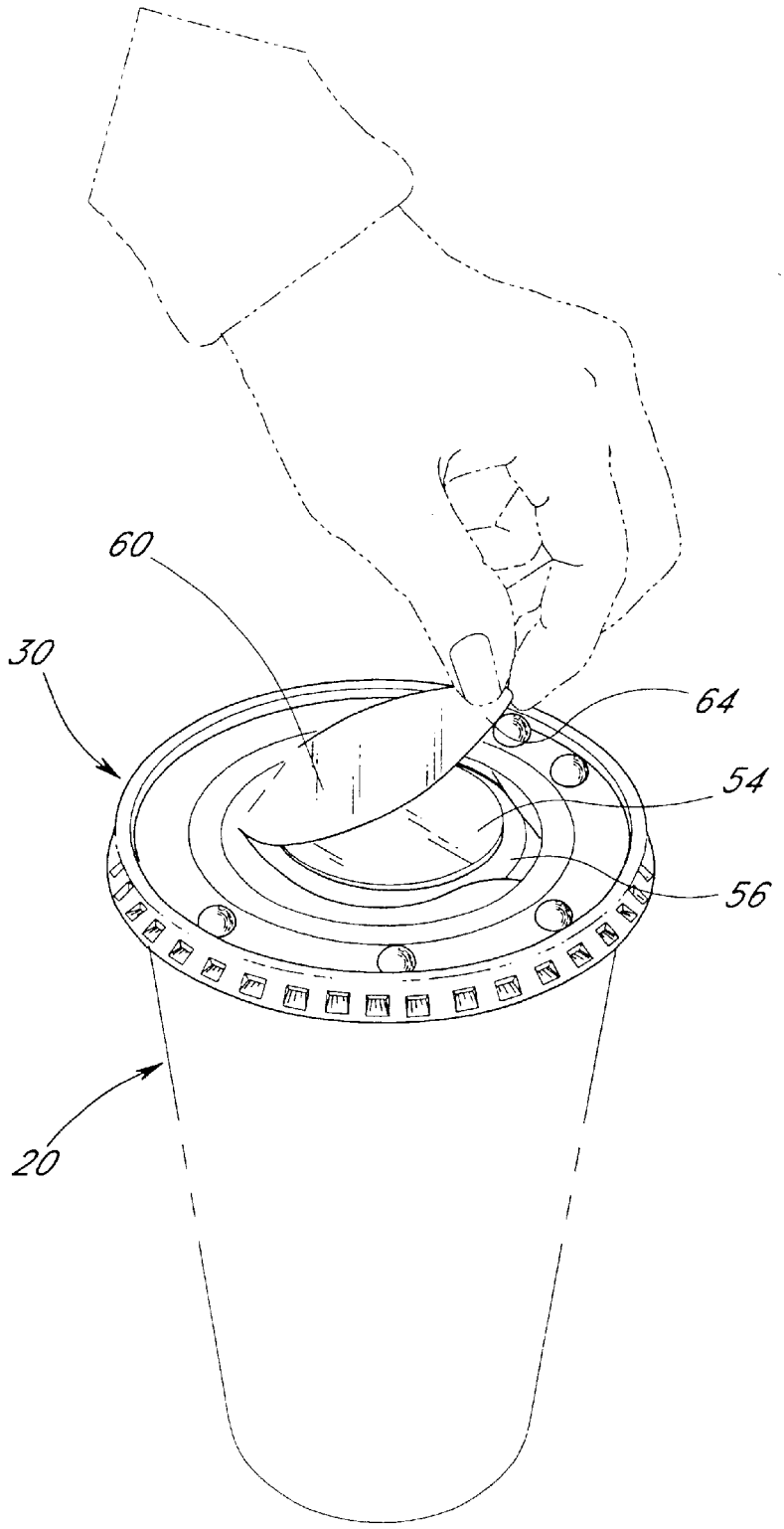
FIG. 7 is a schematic perspective view of the closure of FIG. 1 being opened by a patron.

In use, the restaurants or retail stores will provide a container 20 and a lid 30 to each patron with a purchase of at least a drink. After receipt of the container 20 and the lid 30, a customer lifts the pull tab 64 of the sealing member 60 located on the lid 30, and thereby tears the sealing member 60 along the perforations 66 as shown in FIG. 7. After tearing the sealing member 60, the customer may continue to raise the sealing member 60 and reveal the game piece 54. The customer may then remove and inspect the game piece 54 to see the prize they have received. Following the removal of the game piece 54, the customer may then remove the shield 56 from the recessed well 44. The customer must, therefore, actually tear the sealing member 60, remove the game piece 54, and remove the protective shield 56 to use a straw (not shown) through the hole 52 located within the recessed well 44 of the lid 30.

The present closure provides a way to deliver a noncomformable game piece to a customer in an innovative, convenient and easily accessible region of the closure. The location of the game piece within the closure advantageously calls the patron's attention to the presence of the game piece. The seal of the present closure also keeps the game piece hidden until opened. The seal thus helps to maintain the integrity of any promotional game and to ascertain the odds are accurate. Additionally, the present closure indicates tampering and protects the identity of the game piece concealed within the structure. Further, the present closure ensures that only one game piece is delivered to each patron with each beverage purchase by inventively locating the game piece within a closure for a container.

Although this invention has been described in terms of a certain preferred embodiment, other embodiments apparent to those of ordinary skill in the art are also within the scope of this invention. Accordingly, the scope of this invention is intended to be defined only by the claims that follow.

What is claimed is:

1. A closure for a container, the closure comprising an upper surface, a recessed well formed in the upper surface, the recessed well having a well floor, an opening in the well floor, the opening configured to accept a straw, a shield covering the opening, a prize located within the recessed well, and a sealing member removably attached to the upper surface over the recessed well.

2. The closure of claim 1, wherein the shape of the well floor is generally the same as the shape of the prize.

3. The closure of claim 2, wherein the shape of the well floor and the shape of the prize are circular.

4. A closure for a container, the closure comprising an upper surface, a recessed well formed in the upper surface, the recessed well having a well floor, an opening in the well floor, the opening configured to accept a straw, a prize located within the recessed well, a sealing member removably attached to the upper surface over the recessed well, and a shield located within the recessed well between the prize and the well floor.

5. The closure of claim 4, wherein the shield is made of a liquid-resistant material.

6. The closure of claim 4, wherein the shape of the shield is generally the same as the shape of the well floor.

7. The closure of claim 6, wherein the shield is disc-shaped.

8. The closure of claim 4, wherein the shape of the shield is generally the same as the shape of the prize.

9. The closure of claim 8, wherein the shield and the prize are disc-shaped.

* * * * *

UNITED STATES PATENT AND TRADEMARK OFFICE

CERTIFICATE OF CORRECTION

PATENT NO. : 6,311,860 B1
DATED : November 6, 2001
INVENTOR(S) : Reidinger, D. et al.

It is certified that error appears in the above-identified patent and that said Letters Patent is hereby corrected as shown below:

Title page, Item [54] and Column 1, lines 1 & 2,
Please amend the title to read as follows: -- CONTAINER CLOSURE CONTAINING A PRIZE --

Signed and Sealed this

Twenty-first Day of May, 2002

*Attest:*

*Attesting Officer*

JAMES E. ROGAN
*Director of the United States Patent and Trademark Office*